United States Patent [19]

Ottenhues et al.

[11] 3,969,826

[45] July 20, 1976

[54] APPARATUS FOR PRE-ADJUSTING THE PLATE CYLINDERS OF PRINTING PRESSES

[75] Inventors: Ludger Ottenhues, Riesenbeck; Willi Meyer, Ibbenburen, both of Germany

[73] Assignee: Windmoller & Holscher, Lengerich, Westphalia, Germany

[22] Filed: Aug. 29, 1974

[21] Appl. No.: 501,611

[30] Foreign Application Priority Data

Aug. 30, 1973 Germany ..... 2343855

[52] U.S. Cl. ..... 33/184.5; 33/141 E; 101/426

[51] Int. Cl.[2] ..... B41B 1/00

[58] Field of Search ..... 33/184.5, 141 R, 141 B, 33/141 D, 141 E, 129; 101/426

[56] References Cited

UNITED STATES PATENTS

| | | | |
|---|---|---|---|
| 2,859,532 | 11/1958 | Fogg | 33/184.5 |
| 2,863,220 | 12/1958 | Staples | 33/141 E X |
| 3,316,648 | 5/1967 | Klaassen | 33/141 E X |

*Primary Examiner*—William D. Martin, Jr.
*Attorney, Agent, or Firm*—Fleit & Jacobson

[57] ABSTRACT

In a multi-color rotary printing press equipped with a plate cylinder at each of a plurality of printing stations where a web is to be printed, the rotary positions of the plate cylinders are pre-adjusted to achieve registry of the printing applied at each printing station by setting all the plate cylinders to a respective zero rotary reference position relatively to a frame of the press and then turning each of the second and subsequent plate cylinders out of their zero positions through a respective angle subtended by an arc length calculated by dividing the web length between the first printing station and that at which adjustment is being effected by the circumference of the plate cylinder and subtracting from this quotient the nearest whole number below the quotient. A gauge is provided to facilitate pre-adjustment of the plate cylinders, the gauge being provided with a dial, showing the required adjustment values for the second and subsequent plate cylinders, and a pointer for indicating on a scale the instantaneous value through which the plate cylinder has been turned.

6 Claims, 6 Drawing Figures

APPARATUS FOR PRE-ADJUSTING THE PLATE CYLINDERS OF PRINTING PRESSES

The invention relates to a method of pre-adjusting the plate cylinders of multi-colour rotary printing presses, and to a gauge for performing this method.

Multi-colour rotary printing presses need to be set before a printing run so that each plate cylinder will apply printed matter to a web in registry with the printed matter applied by all the other plate cylinders. For the purpose of setting the plate cylinders, the latter are provided with so called registration marks. The printing press is adjusted by introducing a leading length of the web to be printed up to a first printing station of the press and lowering the presser or impression cylinder so as to apply to the web an impression of the registration mark on the first plate cylinder. The web is then moved along to the second printing station in which the registration mark previously printed on the web is brought into registry with the registration mark provided on the second plate cylinder. For this purpose, the second plate cylinder is rotated until its registration mark covers the mark printed on the web. The web is then fed to the third and further printing stations where each plate cylinder is similarly rotated for the purpose of pre-adjustment.

The entire leading length of web used for the pre-adjustment is discarded as waste. The time required for the pre-adjustment is comparatively long. Also, it is difficult to register the mark on a plate cylinder with the mark on the web because the mark on the web points downwardly and is practically hidden by the impression cylinder. Registration of the marks is particularly difficult if they are located near the middle of the plate cylinders.

It might be mentioned that reference has been made to pre-adjustment of the plate cylinders because a fine adjustment is carried out after the plate cylinders have been set and locked to the drive of the press. Such fine adjustment is usually effected by regulating the amount of web disposed between adjacent printing stations with the aid of a registration roller provided between the printing stations.

Elaborate pre-adjustment of the plate cylinders in the manner hereinbefore described would be unnecessary if the length of web disposed between adjacent printing stations is an accurate whole number multiple of the plate cylinder circumference. In that case, it would simply be necessary to turn all the plate cylinders until their registration marks have assumed the same angular position relatively to the frame of the printing process. In most cses, however, the quotient given by dividing the length of web between adjacent printing stations by the press. of the plate cylinder is a whole number plus a remainder. It is to the extent of this remainder that the second plate cylinder of the press must therefore be turned in relation to the first plate cylinder. The third plate cylinder must then be turned to an extent equal to twice the remainder, the fourth plate cylinder to an extent equal to three times the remainder, and so on.

Pre-adjustment could also be effected by moving the registration rollers that are provided for fine adjustment out of their zero position to the extent of the aforementioned remainder of web length. However, this would mean that the registration rolls would have to be moved through long distances amounting to as much as half the largest plate cylinder circumference.

A high constructional expense would be involved to provide the room between printing stations for allowing movement of the registration rollers through these long distances.

The invention aims to provide a method which, in its preferred form, permits rapid and simple pre-adjustment of the plate cylinders.

According to the invention, in a multi-colour rotary printing press equipped with a plate cylinder at each of a plurality of printing stations where a web is to be printed, a method of pre-adjusting the rotary positions of the plate cylinders comprises setting all the plate cylinders to a respective zero rotary reference position relatively to a frame of the press, turning the second plate cylinder out of its zero position through an angle subtended by an arc length equal to the length of web remaining developed on said second plate cylinder when dividing the length of web between two printing stations by the plate cylinder circumference, and turning each of the subsequent plate cylinders to be traversed by the web out of their zero positions through an angle resulting from developing $n - 1$ times the web length remaining on the $n$th plate cylinder, where $n$ is the number of the particular plate cylinder as counted in the direction of web travel, that is to say for the third plate cylinder $n = 3$, for the fourth $n = 4$, an so on.

Naturally, one would not pre-adjust a plate cylinder by turning it through more than 360°. Accordingly, if the sum of the remainders of web length for the last two or three printing stations is equal to one or more times the circumference of a plate cylinder, then the last few plate cylinders need be turned out of their zero position only through an angle determined by developing the remaining web length resulting from division of the summated remaining lengths by the plate cylinder circumference.

Since the length of web between adjacent printing stations is known, it is a simple matter to prepare tables for the various plate cylinder diameters that are to be used and from these tables one can read the amount through which the individual plate cylinders have to be turned out of their zero position in order to obtain good pre-adjustment. One simple way of carrying out the process of the invention would be to wrap a flexible measuring tape about the plate cylinder whilst it is in its zero position and on this tape one can read the amount through which the plate cylinder has to be turned.

The invention also aims to provide an apparatus to permit the method to be carried out simply and rapidly. According to a second aspect of the invention, therefore, a gauge for facilitating pre-adjustment of the plate cylinders comprises an annular scale, a pointer associated therewith, a wheel which can be brought into driven engagement wih the periphery of a plate cylinder to be adjusted, and a drive transmission for turning the pointer, wherein said transmission has an input pinion driven by said wheel, and can have its transmission ratio changed according to the plate cylinder diameter so that, for each complete revolution of the plate cylinder being adjusted, the pointer sweeps once over the scale.

After the adjustment values corresponding to those provided on the scale of the gauge have been determined or read from a prepared table, the gauge, which is held or mounted in a fixed position relatively to the frame of the press and which, by reason of its adjustable transmission, has been set to the plate cylinder circumference in question, is applied to the plate cylinder by means of the wheel, the plate cylinder being in its zero position. The cylinder is then turned until the pointer of the gauge indicates the desired adjustment value on the scale. The plate cylinder is then coupled to the press in this adjusted angular position.

The drive transmission in the gauge may be in the form of change gearing selected to suit the circumferences of the plate cylinders in the press and the scale reading may indicate the adjustment values required for the various plate cylinders. Each plate cylinder is then turned out of its zero position until the pointer of the gauge that has been brought into contact with the plate cylinder indicates that the required amount of adjustment has been effected.

Preferably, the drive transmission includes a steplessly adjustable friction wheel. In this form of the gauge the pointer may be connected to the friction wheel and a dial is provided bearing numbers which can be read through windows in a stationary disc, the dial being operatively connected to the friction wheel so that, after the dial has been set to the plate cylinder diameter, the adjustment values for the individual plate cylinders can be read from the dial through the windows. When the external wheel has now been brought into driven engagement with the periphery of the plate cylinder to be adjusted, the plate cylinder is turned until the pointer indicates on the scale the adjustment value that is shown in one of the windows.

The gauge preferably includes a housing having means for mounting it on the frame of a printing press and for displacing it radially of a plate cylinder to be adjusted, the mounting means preferably including rails permitting the housing to be displaced axially of a plate cylinder to be adjusted. In this way the wheel of the gauge can be brought closer to or further away from the plate cylinder, depending on the diameter of the latter, the axial displacement being desirable to facilitate illumination of the registration mark on the plate cylinder by a light source provided on the housing.

An example of the invention will now be described with reference to the accompanying drawings, wherein.

Figure 1:
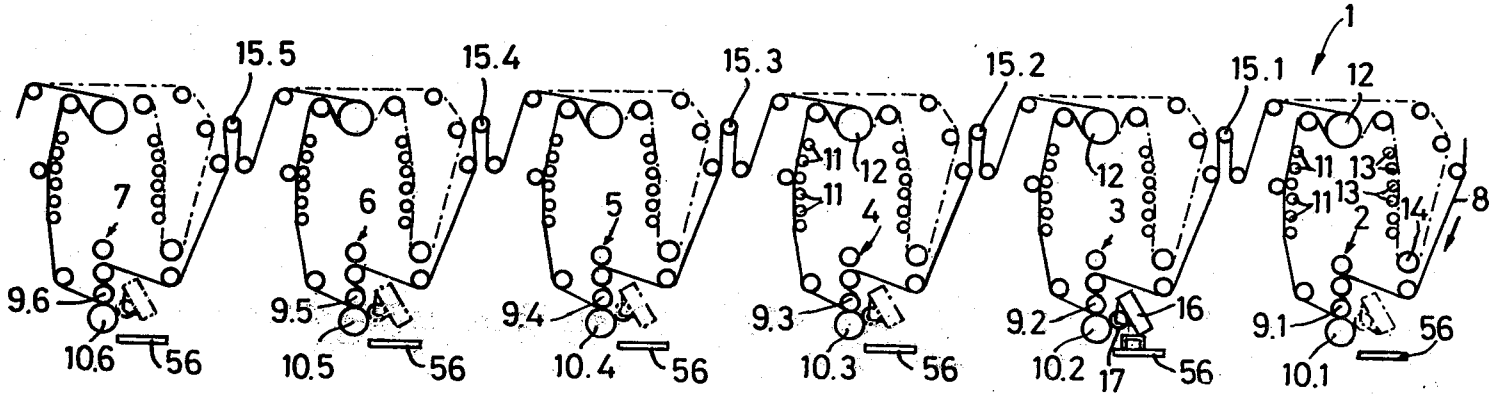
FIG. 1 is a diagram of a multi-colour rotary printing press equipped with six printing stations.

The layout of the printing stations and various guide rolls of a multi-colour rotary printing press 1 is shown in FIG. 1. There are six printing stations 2 to 7, respectively, through which a web 8 is passed in succession. Each printing station includes an impression roller 9.1 to 9.6 and a plate cylinder 10.1 to 10.6. There are supplied with ink in any suitable known manner and driven from a main drive of the printing press.

The course of the web 8 between each printing station may, as indicated in full lines in FIG. 1, include a relatively short drying path along which there are guide rolls 11 and a cooling roll 12 or, as shown in chain-dotted lines, two such drying paths, the second drying path including guide rolls 13 and a cooling roll 14. If the course of the web includes only a single drying path, the length of web between adjacent printing stations may be designated A. With two drying paths in use, the length of web between adjacent printing stations is B. Each plate cylinder 10.1 to 10.6 has a circumference that may be represented by U. The length A or B of the web 8 between the stations can be adjusted within close tolerances by means of registration rollers 15.1 to 15.5 which are disposed between the adjacent printing stations 2 to 7 and are controlled by suitable means (not shown) so that the imprints applied at the various stations will be in registry on the web 8. For this purpose, each of the plate cylinders 10.1 to 10.5 also prints control markings which are scanned by photocells of the registration control means for the purpose of fine adjustment of the web length by means of the registration rollers.

If the web length A or B, as the case may be, is precisely a whole number multiple of the circumference U, the registration rollers 15.1 to 15.5 are simply brought to a zero position and the plate cylinders 10.1 to 10.6 are set so that their registration marks all assume the same angular position with respect to a frame (not shown) of the press. Usually, however, the quotient A/U or B/U is a whole number plus a remainder R, where R will have a value less than the circumference of the plate cylinders. It is in accordance with this remainder R that the second plate cylinder 10.2 must be turned with respect to the first plate cylinder 10.1, the third plate cylinder 10.3 with respect to the second cylinder 10.2, the fourth cylinder 10.4 with respect to the third 10.3, and so on.

Figure 5:
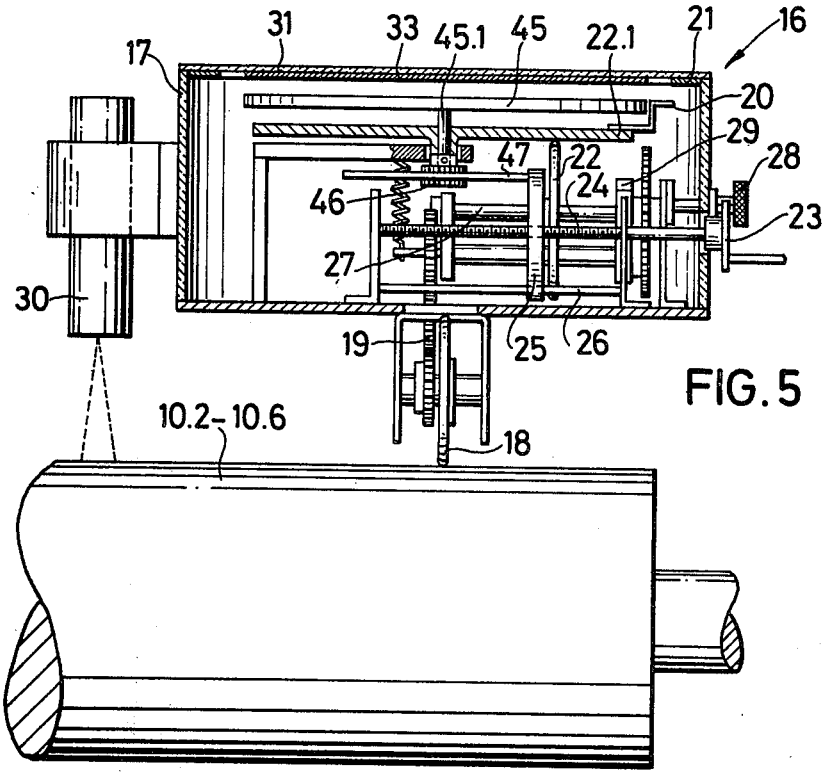
FIG. 5 is a section through the drive transmission of the gauge.
Figure 4:
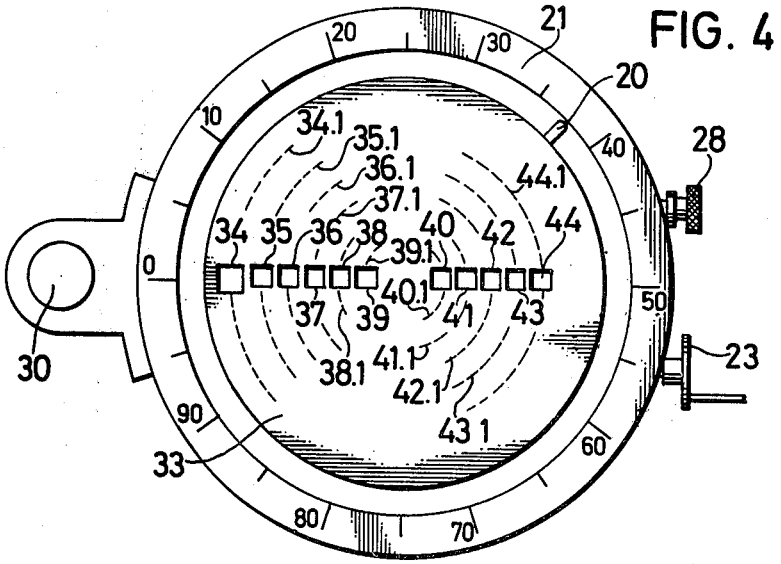
FIG. 4 is a plan view of the gauge.

To permit rapid and simple determination of the angle through which each of the plate cylinders 10.2 to 10.6 must be turned to ensure that the imprints will not be out of registry by the amount R, a gauge 16 is employed. This comprises a housing 17 having a transparent cover 31. At the side of the housing facing the plate cylinder, the gauge has a wheel 18 mounted in flanges projecting at right-angles from the housing. The wheel 18 is brought into contact with the periphery of the respective plate cylinder so that it can be rotated thereby when the plate cylinder is turned. With the aid of gearing 19 (FIGS. 5 and 6), the wheel 18 is operatively connected to a friction wheel 22.1 which carries a pointer 20 for indicating on a scale 21 the amount through which the plate cylinder is turned. The friction wheel 22.1 is driven by a wheel 22 connected to the gearing 19. A hand wheel 23 can be used to change the transmission ratio between the wheels 22 and 22.1 by altering the position of the wheel 22 along the face of the wheel 22.1. The hand wheel 23 is connected to a screw 24 engaged in a nut 25. The nut 25 is prevented from turning by a guide bar 26. The wheel 22 is fixed to rotate with a shaft 27 but is displaceable therealong by means of the nut 25. A knob 28 can actuate a lifting cam 29 which, when actuated, lifts the wheel 22 from the wheel 22.1 and thereby enables the wheel 22.1 and the pointer 20 carried thereby to return to a zero position under the action of a spring.

Figure 3:
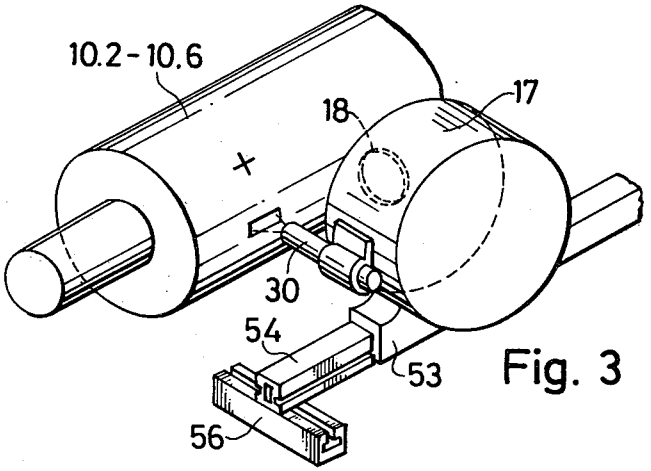
FIG. 3 is a still further enlarged perspective view of the gauge at a printing station.
Figure 2:
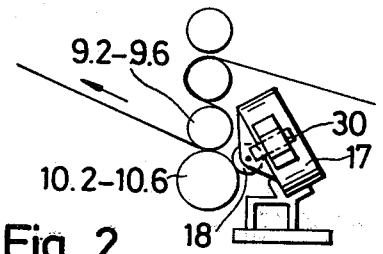
FIG. 2 is an enlarged end elevation of one of the printing stations of the FIG. 1 press.

The housing 17 of the gauge carries a light source 30 for illuminating a narrow elongated area on the plate cylinder (see FIG. 3). When it is to be pre-adjusted, each plate cylinder is turned until the registration mark (see the cross on the plate cylinder in FIG. 3) appears in the area illuminated by the light source 30. The plate cylinder will then be in a zero rotary reference position with respect to the frame of the press on which the gauge 16 is mounted.

The aforementioned scale 21 for indicating the amount of rotation of the plate cylinder out of its zero position in accordance with the transmission ratios of the gearing 19 and friction wheels of the gauge, is provided under the transparent cover 31 of the housing 17. Concentric therewith, the gauge is provided with a cover plate 33 containing windows 34 to 44. Except for these windows, the plate 33 covers a tabulated disc 45 therebeneath. As hereinafter described, the disc 45 is intended to provide readings of the amount through which each plate cylinder should be turned out of its zero position. The pointer 20 and scale 21, on the other hand, serve to show the extent through which the plate cylinder has been turned after the zero positions of the plate cylinder and of the pointer 20 had been set.

The tabulated disc 45 bears numerals on concentric circles 34.1 to 44.1. These numerals are so spaced from one another that they may selectively appear through the windows 34 to 44. The value of the various plate cylinder diameters that might be used in the printing press are entered on the circle 34.1 so that an appropriate one of these values may appear in the window 34. All the other concentric circles are marked with the values based on the aforementioned web length remainders R and in units corresponding to the units used on the scale 21 to indicate the amounts through which the plate cylinders have to be turned to achieve pre-adjustment. Again, these values are entered on the circles 35.1 to 44.1 of the disc 45 so that those adjustment values appropriate to a particular plate cylinder diameter appearing in the window 34 will appear in the windows 35 to 44. This is achieved in that all the adjustment values appropriate to a particular plate cylinder diameter are entered on a diameter of the numerical disc 45, the windows 34 to 44 being likewise arranged on a diameter of the cover plate 33. As already mentioned, the value of a particular plate cylinder diameter will appear in the window 34 and the arrangement is preferably such that the angle through which the plate cylinder 10.2 has to be turned will appear in the window 35, the adjustment angle for the plate cylinder 10.3 in the window 36, and so on. The values in the windows 35 to 39 are applicable if the web has the length A between printing stations whilst the values in the windows 40 to 44 will be applicable for a web length E. Accordingly, the web lengths A and B and the plate cylinder diameter are the parameters that determine the construction of the gauge 16 and the tabulation on its dial.

The numerical disc 45 is carried by a shaft 45.1 passed through the friction wheel 22.1 and rotatably mounted therein. Fixed to the shaft 45.1 there is a pinion 46 in engagement with a rack 47. The latter is fixed to the nut 25. Thus, when setting the transmission ratio between the wheels 22 and 22.1 by displacing the nut 25 with the aid of the hand wheel 23, the disc 45 is also turned so that, when the proper transmission ratio has been set for a particular plate cylinder diameter, the appropriate numerical values will appear in the windows 34 to 44 of the plate 33. Further, displacement of the friction wheel 22 is so coupled to the rotation of the numerical disc 45 that the pointer 20 will make one complete revolution along the scale 21 under the action of the wheel 18 when the plate cylinder is rotated through one complete turn.

Figure 6:
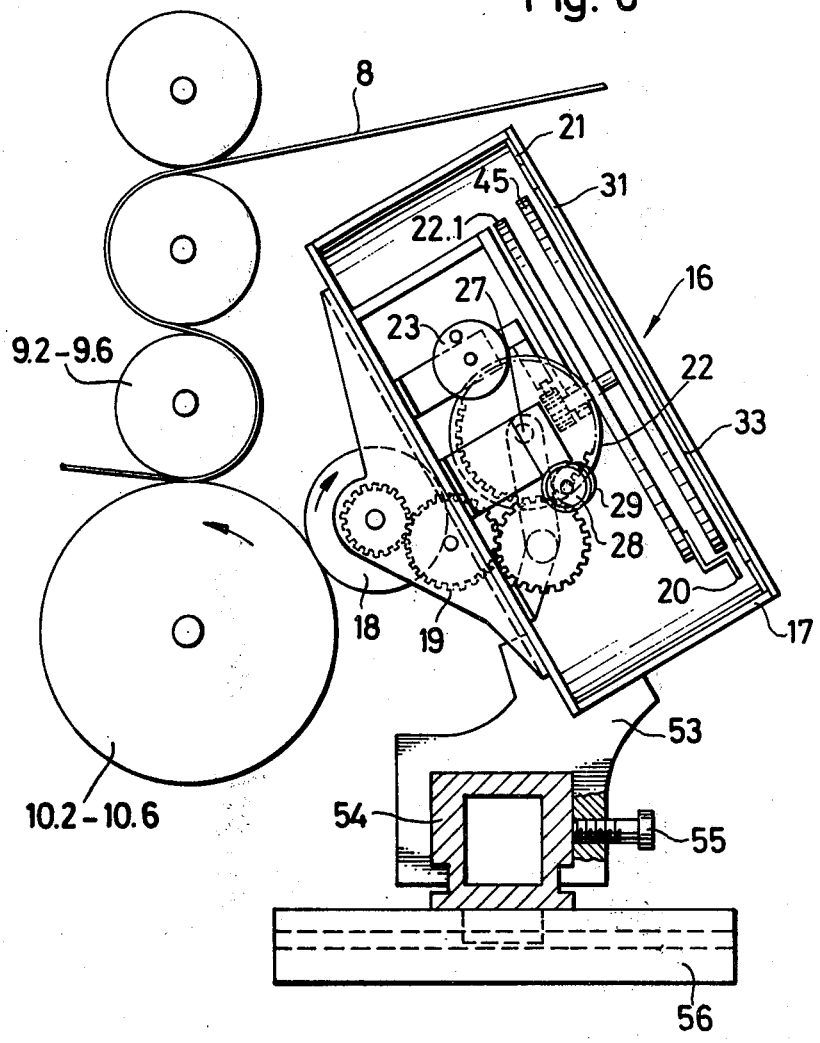
FIG. 6 is a very much enlarged view corresponding to FIG. 2.

As best shown in FIGS. 3 and 6, the housing 17 of the gauge 16 carries a sleeve 53 in which a guide rail 54 is a close slide fit. The gauge can be fixed in position along the rail 54 by means of a screw 55. The rail 54 is carried by bars 56 which are attachable to the frame of the press and along which the rail 54 is displaceable. The rail 54 is disposed parallel to the plate cylinder axis and the bars 56 at rightangles thereto. Accordingly, the gauge 16 can be positioned so that the wheel 18 touches the plate cylinder periphery and so that the light source 30 will be in line with the registration mark on the plate cylinder.

The gauge 16 is employed for pre-adjustment of the plate cylinders in the following manner.

The hand wheel 23 is first turned until the numeral corresponding to the diameter of the plate cylinders with which the press is equipped appears in the window 34. The corresponding readings giving the values by which the various plate cylinders should be adjusted will then be visible in the windows 34 to 39 or 40 to 44, depending on whether the web 8 is to be passed through a single or two drying paths between the printing stations. The plate cylinder 10.1 at the first printing station 2 is now brought to a zero angular position with the aid of the light source 30 of the gauge 16 and this plate cylinder is then coupled to the drive of the press. The wheel 18 of the gauge is then brought into contact with the periphery of the plate cylinder 10.2 which is turned to its zero rotary reference position at which the registration mark on the cylinder 10.2 will appear in the area illuminated by the light source 30. The knob 28 of the gauge is now turned to lift the wheel 22 from the friction wheel 22.1 and allow the pointer 20 to be spring-influenced to its zero position. When the plate cylinder 10.2 is now turned, the wheel 18 is rotated thereby and the pointer 20 will be moved along the scale 21 to indicate the angular position of the plate cylinder out of its zero position. When the pointer 20 indicates on the scale 21 a reading corresponding to the adjustment value given in the window 35 or 40, rotation of the plate cylinder 10.2 is terminated because the cylinder is then pre-adjusted and has to be coupled to the drive of the press in this pre-adjusted position, any required fine adjustment being effected by moving the web with the aid of the registration roller 15.1. Similarly, each of the subsequent plate cylinders 10.3 to 10.6 is pre-adjusted and coupled to the drive of the press when the pointer 20 indicates the value given in the appropriate window of the dial of the gauge.

We claim:

1. A gauge for pre-adjustment of a plurality of printing cylinders in a multi-color rotary printing press having a plurality of printing stations, each including one of the printing cylinders for a web advancing in a path comprising, in combination, a housing, a contact roller rotatably mounted on said housing for rolling engagement with the periphery of a printing cylinder to be pre-adjusted, a dial on said housing, a drive transmission for drivably connecting said contact roller to said dial for indicating on said dial the angular displacement of a printing cylinder in peripheral contact with said roller, means for adjusting the transmission ratio of said drive transmission, indicia means on said housing including a plurality of printing cylinder diameters and a plurality of angular adjustment values for each of the printing cylinders with respect to each of the cylinder diameters of the indicia means and means for operatively connecting said indicia means to said transmission ratio adjustment means whereby the transmission ratio is adjusted by said adjusting means in relation to a selected cylinder diameter of said indicia means for angular adjustment of all of said plurality of printing cylinders with said gauge in accordance with the adjustment values corresponding to said selected cylinder diameter.

2. A gauge according to claim 1, wherein said drive transmission includes a steplessly adjustable friction wheel.

3. The gauge according to claim 2, wherein said dial includes a pointer connected through said drive transmission to said friction wheel and wherein said indicia means includes a plate on said housing having a plurality of windows and a dial provided with said plurality of cylinder diameters and said adjustment values, said dial being operatively connected to said friction wheel whereby both the selected cylinder diameter and the adjustment values for said plurality of printing cylinders can be read on said dial through said windows.

4. A gauge according to claim 1, including means for mounting said housing on the frame of the printing press for radial displacement relative to a printing cylinder to be adjusted.

5. A gauge according to claim 4, wherein said housing mounting means includes rails for permitting said housing to be displaced axially of a printing cylinder to be adjusted.

6. A gauge according to claim 4, including a light source on said housing for illuminating a registration mark on the printing cylinders.

* * * * *